US011548778B2

(12) United States Patent
Powell

(10) Patent No.: US 11,548,778 B2
(45) Date of Patent: Jan. 10, 2023

(54) SADDLE RIGGING LIMITING STIRRUP STRAP MOVEMENT, AND METHODS

(71) Applicant: Equibrand Corporation, Granbury, TX (US)

(72) Inventor: Edwin Charles Powell, Commerce, TX (US)

( * ) Notice: Subject to any disclaimer, the term of this patent is extended or adjusted under 35 U.S.C. 154(b) by 824 days.

(21) Appl. No.: 15/530,313

(22) Filed: Dec. 21, 2016

(65) Prior Publication Data

US 2017/0197819 A1 Jul. 13, 2017

Related U.S. Application Data

(60) Provisional application No. 62/387,882, filed on Jan. 8, 2016.

(51) Int. Cl.
*B68C 1/16* (2006.01)
*B68C 3/00* (2006.01)

(52) U.S. Cl.
CPC . *B68C 1/16* (2013.01); *B68C 3/00* (2013.01)

(58) Field of Classification Search
CPC .... B68C 1/02; B68C 1/04; B68C 1/16; B68C 3/00
See application file for complete search history.

(56) References Cited

U.S. PATENT DOCUMENTS 1,212,545 A * 1/1917 Nickel ..... B68C 1/025 54/44.7
1,226,623 A * 5/1917 Adams ..... B68C 1/16 54/46.2
1,700,792 A * 2/1929 Ernst ..... B68C 1/02 54/44.1
2,008,977 A * 7/1935 Connolly ..... B68C 1/02 54/44.1
2,037,406 A * 4/1936 Elliott ..... B68C 1/16 54/46.2
2,207,982 A * 7/1940 Hamley ..... B68C 1/16 54/46.2
2,474,953 A * 7/1949 Mock ..... B68C 1/02 54/46.2
2,525,849 A * 10/1950 Allison ..... B68C 1/16 54/46.2

(Continued)

FOREIGN PATENT DOCUMENTS

EP 692450 A1 * 1/1996 ..... B68C 1/02

OTHER PUBLICATIONS

EP0692450B1 machine translation (Year: 1996).*
Equiband™ website snowing The MurdocK Method (see attached 5 pages).

*Primary Examiner* — Son T Nguyen
(74) *Attorney, Agent, or Firm* — Gregory Perrone; Bobby W. Braxton; Braxton Perrone, PLLC

(57) ABSTRACT

Disclosed is a rigging for a saddle, a saddle containing this rigging and a method of making the rigging wherein the rigging has a slot in the rigging material, the slot being large enough for at least a part of a stirrup leather or stirrup strap loop to pass through the slot, the rigging slot having a width for limiting the movement forward and/or rearward of a stirrup that is supported by the stirrup strap loop, the slot in the rigging located spaced downward on the saddle from a slot in a saddle tree of the saddle that supports the stirrup leather or stirrup strap loop.

20 Claims, 9 Drawing Sheets

(56) References Cited

U.S. PATENT DOCUMENTS

| | | | | |
|---|---|---|---|---|
| 3,716,965 | A * | 2/1973 | Douglas | B68C 1/02 54/46.2 |
| 4,265,075 | A * | 5/1981 | Motsenbocker | B68C 1/02 54/44.5 |
| 5,048,272 | A * | 9/1991 | Saare | B68C 1/02 54/44.1 |
| 2001/0009092 | A1 | 7/2001 | Gronberg | |
| 2005/0229552 | A1 | 10/2005 | Dubourg | |
| 2008/0098700 | A1 | 5/2008 | Beal et al. | |
| 2008/0256909 | A1 * | 10/2008 | Streifel | B68C 1/02 54/44.1 |
| 2014/0260125 | A1 * | 9/2014 | Rehmeyer | B68C 1/16 54/46.1 |
| 2015/0135655 | A1 | 5/2015 | Mayr | |

* cited by examiner

SADDLE RIGGING LIMITING STIRRUP STRAP MOVEMENT, AND METHODS

The present application claims the benefit of Provisional Application No. 62/387,882 filed on Jan. 8, 2016.

The present invention relates to new types of animal saddles having new kinds of rigging to limit the movement of the stirrup straps and thus the movement of the stirrups generally parallel to the sides of the animal on which the saddle is mounted, and methods of making such saddles.

BACKGROUND

The location of the stirrups while a person is riding an animal, such as a horse or other equine, is important to the stability of the rider, particularly when riding fast, over rough terrain, turning, or going down steep grades. For example, in certain circumstances the rider has a tendency to push the stirrups backward and when this happens the rider's upper body is moved forward and is in a very unstable position that often causes falls from the saddle. Some have suggested and used extra parts for the saddle to try to reduce this undesirable cause and results, but those means have increased the cost of the saddles and usually distracted from the esthetics of the saddle. For example, something called the Murdoch Method is known that uses a product called Equiband that must be tied, or otherwise attached, to each stirrup and then passes over the back of the saddle to prevent or reduce the tendency for the stirrups to be moved forward parallel to the animal. This method and product makes the saddle unsightly to say the least and tends to be too limiting since it is important that the rider is able to move the stirrups forward and backward to some degree in different circumstances.

What is needed is a saddle that limits stirrup movement generally parallel to the sides of the animal on which the saddle is mounted without adding significant manufacturing cost to the saddle and without distracting or reducing the appearance of the saddle.

SUMMARY

The invention includes new types of saddles, new types of saddle rigging and methods of making these saddles, saddles that limit the movement of the stirrups generally parallel to the sides of the animal, but still provide a desirable and important amount of stirrup movement generally parallel to the sides of the animal, preferably do not detract from the appearance of the saddles and do not increase the cost of the saddles more than the value of the added performance of the saddles. While the invention applies to saddles for any kind of animal on which saddles are used, for simplification only the saddles designed for Equine animals, including horses, ponies, mules, burros, horse saddles are discussed below.

The limiting device(s) of the invention that provide the desirable limited stirrup leathers movement and hence the stirrups movement generally parallel to the sides of the animal are new types of saddle rigging that cooperate with the stirrup leathers or stirrup strap loops at a location providing good leverage to limit the movement of the stirrup strap loops and thus limit the movement of each stirrup generally parallel to the side of the horse. These new riggings and saddles they are part of are called Stirrup Positioning Rig Slot(s)™ (SPRS™). The new rigging device(s) include a slot in the rigging spaced from and on each side of the front to back centerline of the saddle, each slot being for at least one part of the stirrup leather or stirrup strap loop to pass through, the slot being spaced from a slot, or other known device in a saddle tree that supports the stirrup leather or stirrup strap loop. The slots in the new rigging limit the rearward and/or forward movement of at least one part of the stirrup leather loop and thus limit the range of movement of the stirrups generally parallel to the sides of the horse.

The new type of rigging has a slot or slots and/or devices in the new rigging that are fixed to allow the desired stirrup movement desired, or can be adjustable to change the effective length of the slot that at least one part of the stirrup leather passes through to prepare the saddle for various uses and expected situations. These new types of riggings each contain a stirrup strap limiting device. in some embodiments a slot, located spaced downward from a slot or other device in each of the bars of a saddle tree that hold, support a stirrup leather or stirrup strap loop, at least one part of the stirrup strap loop passing through this stirrup strap limiting device, slot, in, or on, each rigging such that the shape and/or orientation and/or location and length of the slot in each rigging controls the amount of each stirrup leather and stirrup movement. One or more of the shape, orientation, location and length features of the rigging slot or device can be changed to customize a saddle for its intended purpose and also one or more of these features can be adjusted on some saddle embodiments such as to customize the same saddle of the invention for different purposes or circumstances. Herein when stirrup leather, stirrup leather loop, stirrup strap or stirrup strap loop is or are used, (they mean the same thing). Hereafter, these will be called stirrup strap loop. Also, with respect to the inventions disclosed herein, each side of the saddle, on each side of the front to back centerline of the saddle, is substantially the same even through only one side of the saddle may be shown and/or described.

One embodiment of the invention is a saddle having a rigging containing a slot in the rigging spaced downward from a slot in the saddle tree bar that supports the stirrup strap loop, the slot preferably oriented at an angle having the end of the slot closest to the pommel spaced a smaller distance from the slot in the tree bar than the end of the slot closest to the cantel of the saddle. One side, the back side, of the stirrup strap loop passes through the slot in the rigging to limit the movement of the stirrup strap loop and thus the movement of the stirrup in the general direction parallel to the side of the horse.

In a particularly preferred embodiment the front of the slot is spaced about 4 inches from the bar slot while the back of the slot is spaced about 6 inches from the bar slot and the length of the rigging slot in this most preferred embodiment is about 4 inches. In other embodiments in this orientation of the front of the rigging slot can be spaced from about 3 or 4 inches to about 6 inches from the bar slot and the back of the rigging slot can be spaced from about 6 inches to about 8 inches or more from the bar slot, however, while less preferred, the rigging slot orientation can be generally parallel to the bar slot. It is important that the rigging slot be spaced from the tree bar slot to provide leverage on the stirrup strap loop to more limit, better limit the stirrup movement.

While the drawings disclosed herein are directed to western style saddles, the invention also includes English type and any other type of saddles for animals including horses, ponies, burros, mules, bovine and other animals on which saddles can be used.

Herein, when a range of number values is disclosed it is to be understood by those of ordinary skill in the appropriate art(s) that each numerical value in between the upper limit and the lower limit of the range is also disclosed, to at least 0.01 of a full number. Thus in a range of 1 to 10, this includes 2.04 to 10, 3.06 to 8 or 8.50, and so on. The addition of a new limitation in a claim previously stating from 2 to 7 changing it to from 3-7 or 4-6 would not introduce new matter whether those new ranges were specifically disclosed in the specification or not because of this explanation of the meaning of a disclosed broader range, such as 1-10. This meaning of a range is in keeping with the requirement in 35 USC 112 that the disclosure be concise.

Further, when the word "about" is used herein it is meant that the amount or condition it modifies can vary some beyond that stated so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION OF SOME EMBODIMENTS AND BEST MODE

Figure 1:
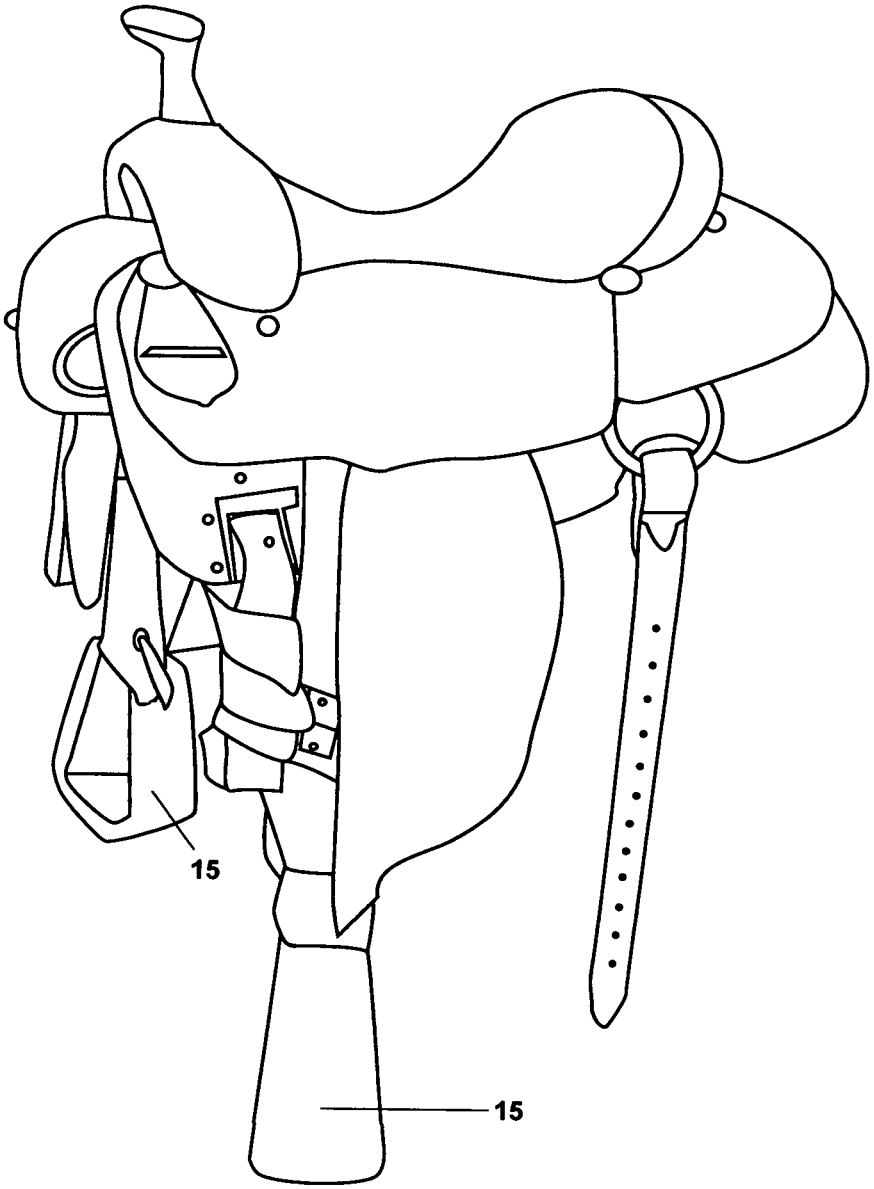
Figure 1 (Prior art)
FIG. 1 is a perspective view of a typical prior art western saddle.
Figure 1A:
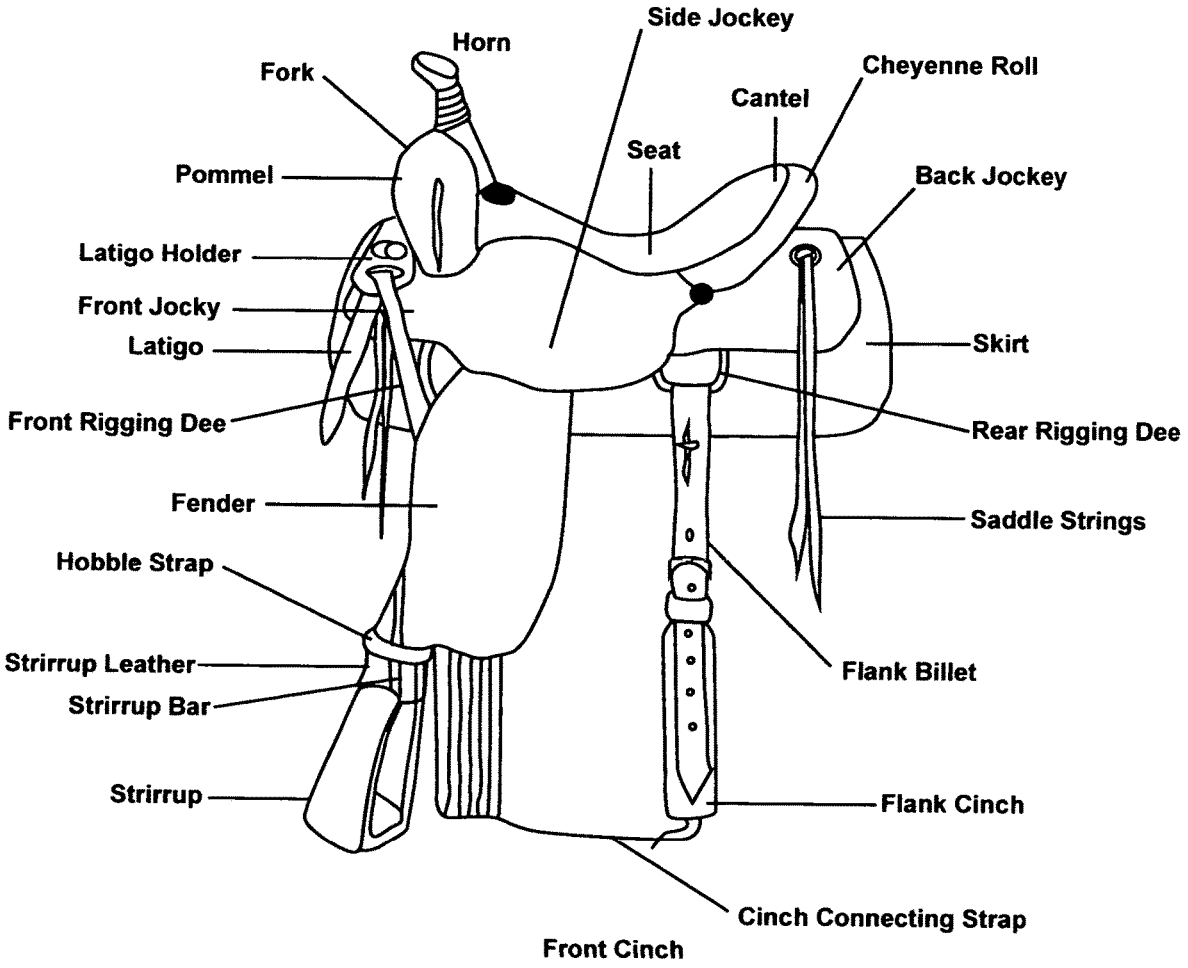
FIG. 1A is a side view of a known western saddle with the visible parts of the saddle labeled.
Figure 1B:
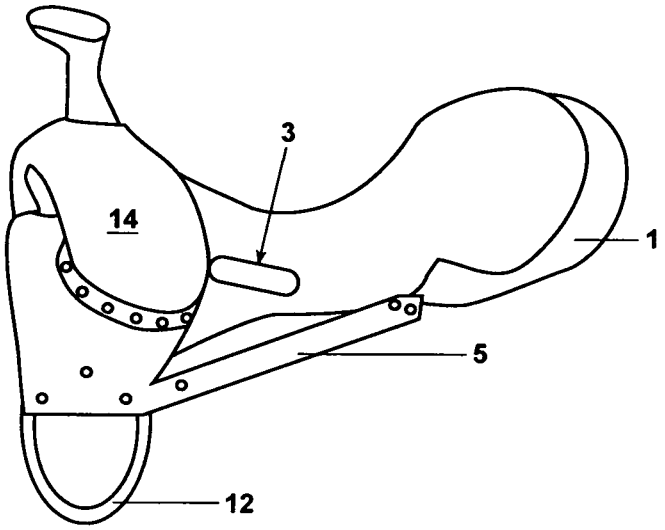
Figure 1B (Prior art)
FIG. 1B is a side view of a prior art western saddle under construction showing a slot in the saddle tree bar of a typical prior art rigging.

FIG. 1 is a perspective view showing a typical western saddle. FIG. 1A is a side view of a known western saddle with the visible parts of the saddle labeled. FIG. 1B is a side view of a known western saddle being constructed showing a slot 3 in a bar of a saddle tree 1 and a typical prior art rigging 5 attached to the saddle tree 1 adjacent a pommel 14. The rigging 5 holds a Dee ring 12 on its front, lower corner.

Figure 1C:
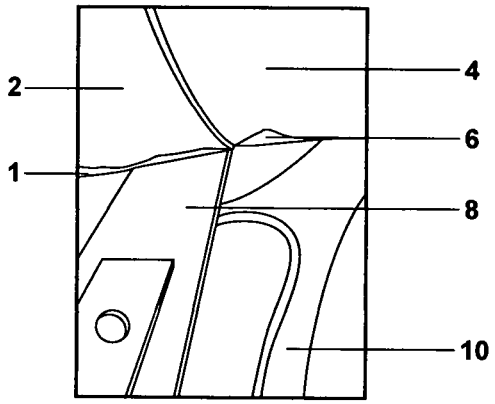
Figure 1C (Prior art)
FIG. 1C is a partial side view showing a stirrup strap loop after passing through the slot in the saddle tree bar and supported by the saddle tree bar.

FIG. 1C is a partial side view of the prior art saddle of FIG. 1 showing a back part of a stirrup strap loop 8 that, having passed through the slot 3 (not seen in this view) in the bar of the saddle tree 1. See a bottom edge 6 of the saddle tree 1, with the front part of the stirrup leather loop 2 passing over a skirt 10 and under a seat jockey 4 of the saddle.

Figure 1D:
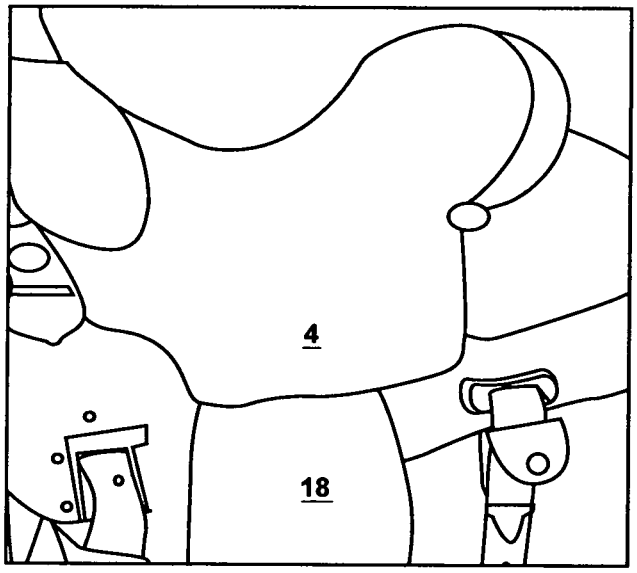
Figure 1D (Prior art)
FIG. 1D is a partial side view of a prior art saddle with the fender, stirrup strap loop and stirrup in the vertical, neutral position.
Figure 1E:
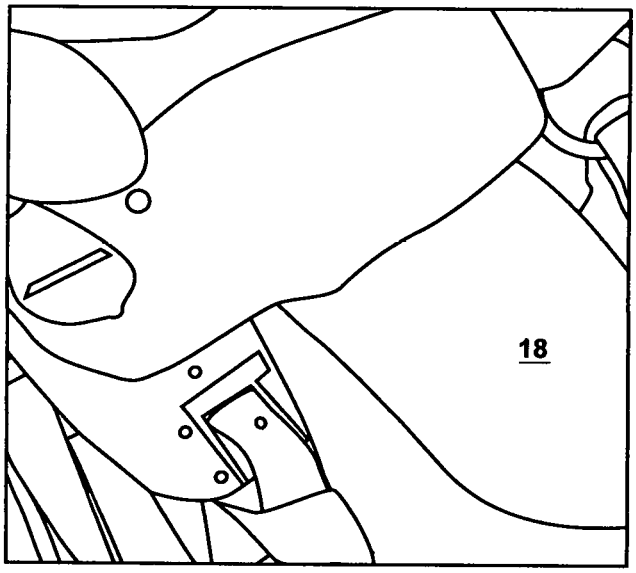
Figure 1E (Prior art)
FIG. 1E is a partial side view of a portion of the saddle of FIG. 1D, but showing the fender, and thus the stirrup strap loop and stirrup, in the backward limit of movement.

FIG. 1D, a partial side view of a prior art saddle similar to that shown in FIG. 1 and shows the fender 14 in the vertical position. FIG. 1E shows this same prior art saddle with the fender 14 in the maximum rearward position wherein the bottom of the fender 18 has moved back from vertical 9-9½ inches and the top of the fender 18 has moved backward about 3 inches.

Figure 1F:
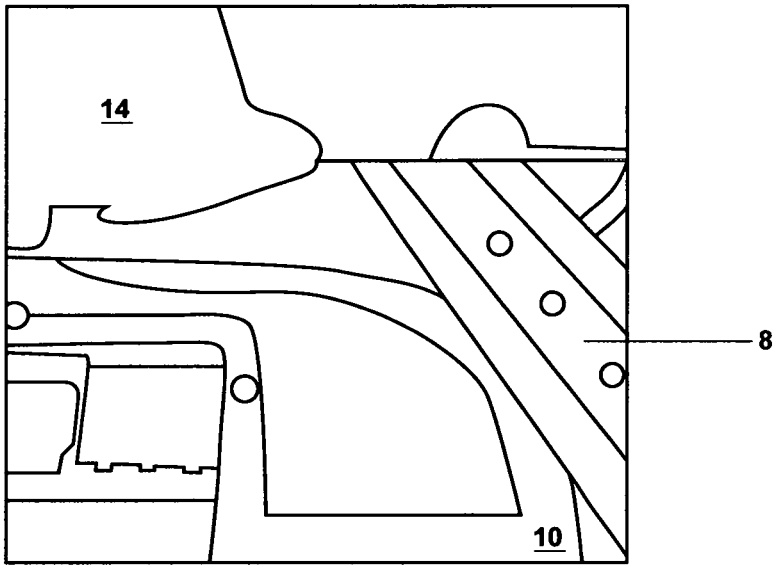
Figure 1F (Prior art)
FIG. 1F is a partial side view of a portion of the saddle of FIG. 1D showing the stirrup strap loop in the backward limit of movement.
Figure 1G:
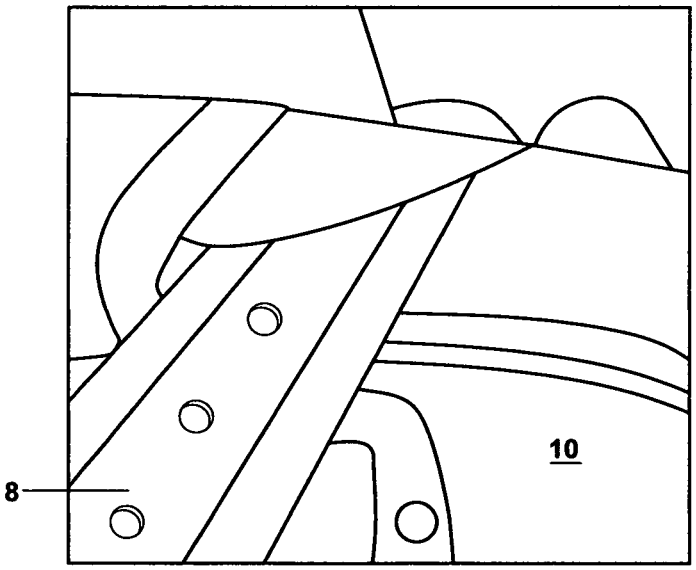
Figure 1G (Prior art)
FIG. 1G is a partial side view of a portion of the saddle of FIG. 1D, showing the stirrup strap loop in the forward limit of movement.

FIG. 1F is a portion of this same saddle of FIG. 1E showing the stirrup leather 8 in the maximum rearward position producing the amount of movement from vertical given just above. FIG. 1G is a partial side view of a portion of the same saddle of FIG. 1D, but with the stirrup leather 8 or stirrup strap loop in the maximum forward position allowing the top of the fender 18 to move forward about 3 inches from the vertical position and the bottom of the fender to move forward from vertical about 9½ inches. The maximum amount of rearward movement of the fender 18 and stirrup 15 would put the rider in a very unstable and dangerous position if the horse was moving fast, sliding down a steep grade and/or turning.

Figure 2:
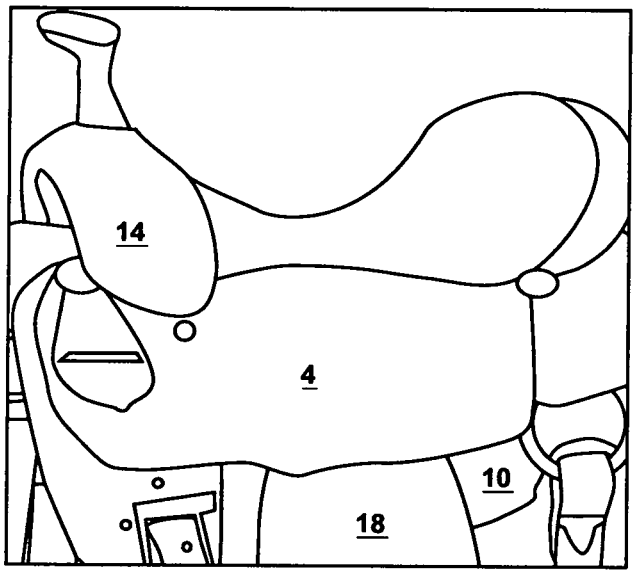
FIG. 2 is a partial side view of one western saddle of the invention.
Figure 2B:
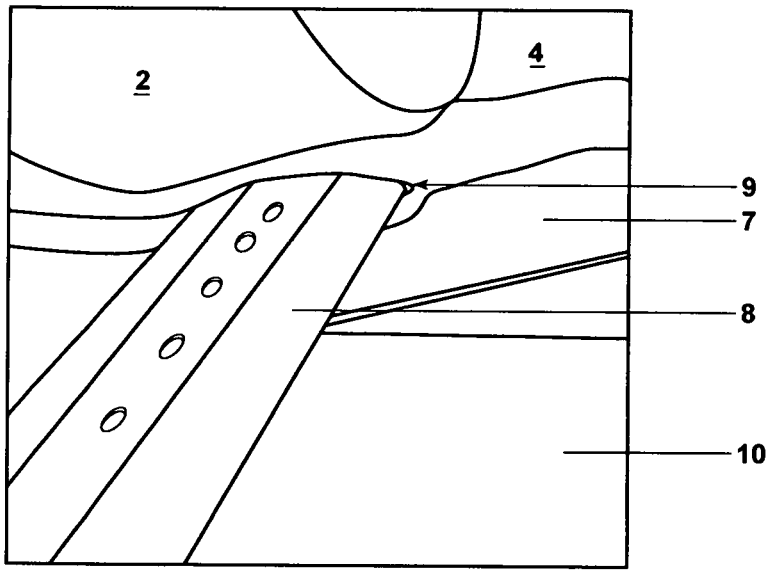
FIG. 2B is a partial side view of a portion of the western saddle of the invention showing one side of the stirrup leather loop passing out of a slot in the rigging of the invention.
Figure 2A:
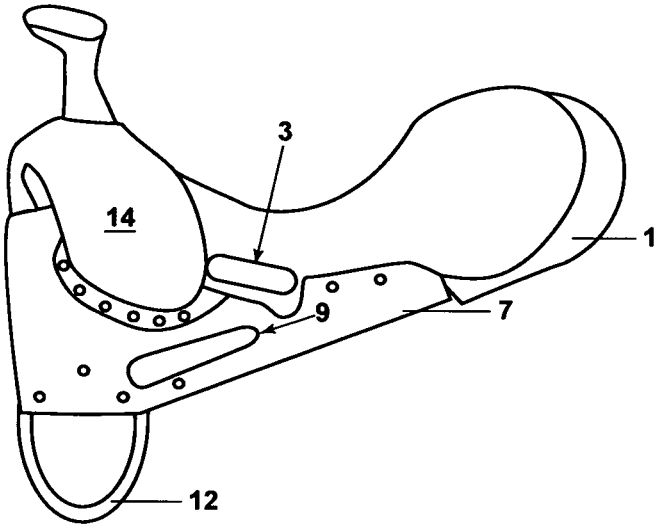
FIG. 2A is a side view of one western saddle of the invention being constructed showing a novel rigging for limiting the movement of a stirrup leather loop.

FIG. 2 is a partial side view of a western saddle of the invention with the fender 18 in a vertical position. FIG. 2A is a side view of a western saddle of the invention being constructed showing a preferred embodiment of the invention including a novel rigging 7 fastened to the saddle tree 1 adjacent the pommel 14 and containing a downward sloping, back to front, slot 9, spaced downward from the slot 3 in the bar of the saddle tree 1. The purpose of this slot 9 is to limit the movement of the one of the stirrup straps loop 8, preferably a back strap of the stirrup leather loop 8 (see FIG. 2B) in a direction generally parallel to the side of a horse on which the saddle is mounted as will be seen later. FIG. 2B, a partial perspective view showing a portion of the western saddle of the invention of FIG. 2 and the novel rigging 7, but further constructed and showing one side of the stirrup leather loop 8 passing out of the slot 9 in the rigging 7 of the invention. The other side 2 of the stirrup loop 8 passes over the top of this side of the stirrup loop 8 coming out of the slot 9 in the rigging 7 of the invention, the other side 2 being in this example the backside of the fender 18.

In this particularly preferred embodiment of FIGS. 2A and 2B, the back of the slot 9 (see FIG. 2A) is spaced about 4 inches from the back of the saddle tree bar slot 3 while the front of the slot 9 is spaced about 6 inches downward from the front of the bar slot 3. In other embodiments these distances between the rigging slot 9 and said bar slot 3 can be in the ranges of about 4 to about 6 inches at the back and about 5 or 6 inches to about 8 inches in the front. It is important that the rigging slot 9 be spaced from the saddle tree bar slot 3 to provide leverage on the stirrup strap loop to provide the desired limitation on the range of movement of the stirrups. While the most preferred slot orientation is that shown in FIG. 2A, it may sometimes be permissible that the rigging slot 9 is parallel to said bar slot 3 or even in some situations tilted in the opposite direction, the front end of said slot 9 being closer to said bar slot 3 than the back end of said slot 9.

The length of the rigging slot 9 is most preferably about 4 inches long, but can be in the range of about 3 or about 4 inches to about 6 inches long. The greater the distance between the saddle tree bar slot 3 and the slot 9 in the rigging 7, the greater the leverage on the stirrup leather 8 to limit its movement forward or backward. While less preferred, the orientation of the slot 9 in the rigging 7 can be generally parallel to the saddle tree bar slot 3.

Figure 3:
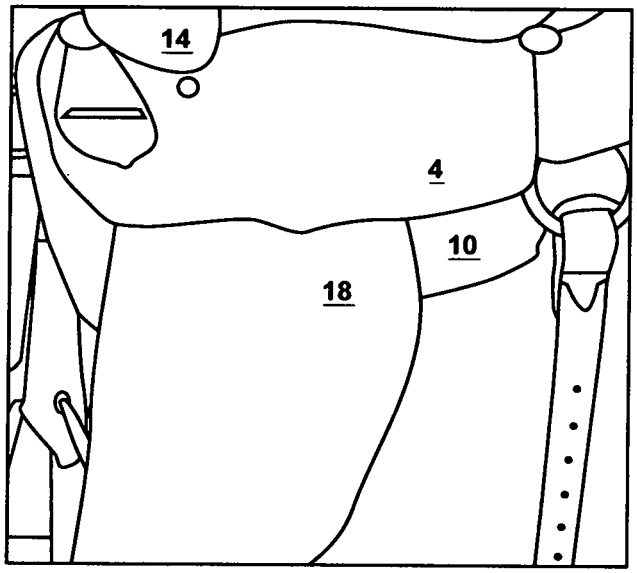
FIG. 3 is a partial side view of a portion of a preferred western saddle of the invention showing the maximum forward movement of the fender (stirrup strap loop and stirrup not shown or not clearly shown).
Figure 4:
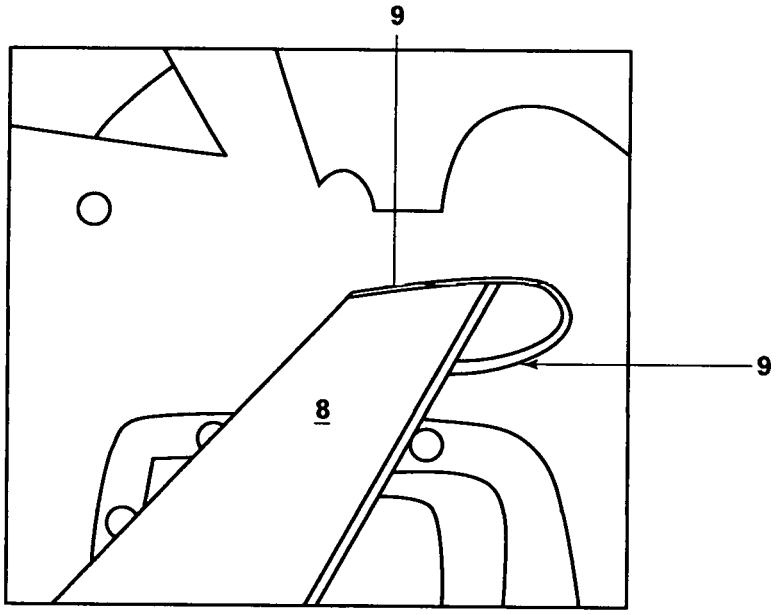
FIG. 4 is a partial side view showing a portion of the saddle of FIG. 3 showing the one part of the stirrup strap loop coming out of the rigging slot of the invention with said part in a maximum forward position.

FIG. 3 is a partial side view of the saddle like FIG. 2 showing a portion of another preferred western saddle of the invention with the fender 18, stirrup strap loop 8 and stirrup 15 pulled forward to its maximum limit. This forward movement of the fender 18 is about 9 inches at its bottom and about 3 inches at the top of the fender 18. FIG. 4 is a partial perspective view of the saddle of FIG. 3 showing one part of the stirrup strap loop 8 coming out of the rigging slot 9 with the stirrup strap loop part 8 in the maximum forward position, because of the rigging slot 9, when the fender 18 is in the position shown in FIG. 3.

Figure 5:
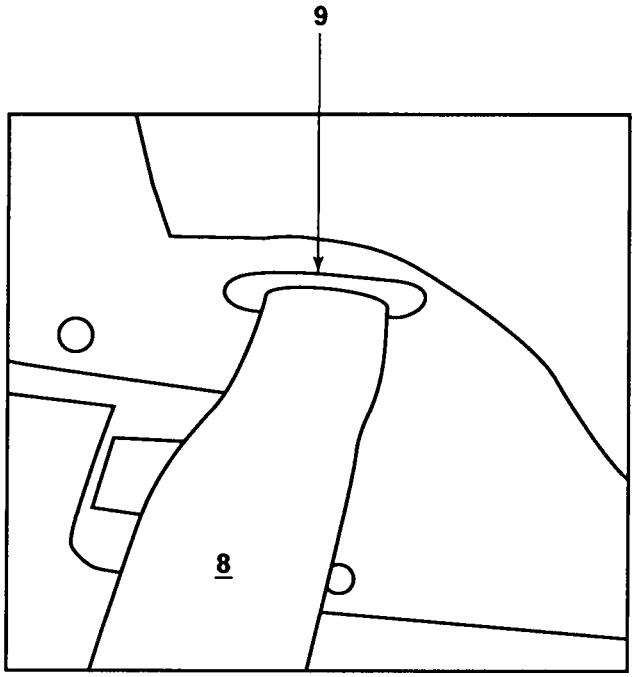
FIG. 5 is a partial side view showing a portion of the saddle of FIG. 3 showing the one part of the stirrup strap loop coming out of the rigging slot of the invention with said part in a maximum rearward position of this saddle.
Figure 6:
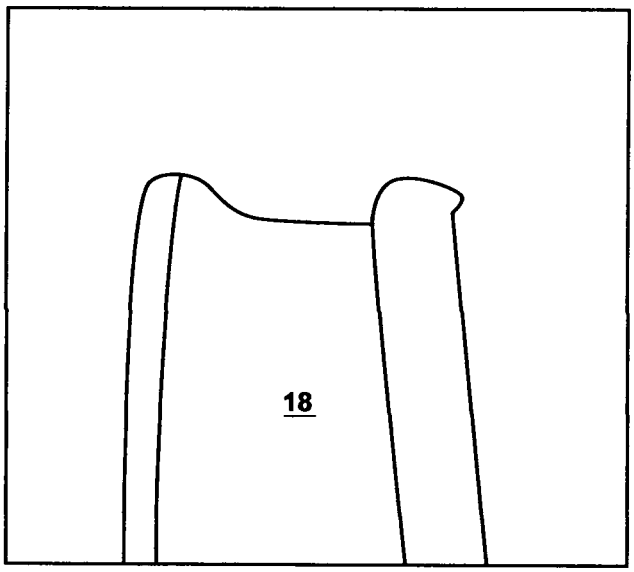
FIG. 6 is a partial side view of the saddle of FIG. 3 showing the most, maximum rearward position of the fender of the preferred saddle of the invention.

FIG. 5 is similar to FIG. 4, but in this partial side view of a portion of the same saddle shown in FIG. 4, the part of the stirrup strap loop 8 is coming out of the rigging slot 9 in the maximum rearward position which in this embodiment is vertical, the slot 9 being about 4 inches long and in the orientation shown in FIG. 2A. FIG. 6 is a side view of a portion of the fender 18 of the same saddle shown in FIGS. 3, 4 and 5 showing one fender 18 of this saddle in the maximum rearward position, which is vertical.

While the preferred mechanism for limiting the rearward and/or forward movement of the stirrup leather(s) is one or more slots in the rigging of the saddle as shown, other mechanisms serving the same purpose and even being adjustable are included in the invention, e.g. placing inserts in each end of a long slot to shorten the length of the slot for special purposes and other things that will shorten the length of a long rigging slot.

Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. A saddle for an equine, the saddle comprising a saddle tree with a front to back center line, a saddle tree slot in each side of the saddle tree spaced from the front to back centerline, a stirrup strap loop or stirrup leather supported by each saddle tree slot in each side of the saddle tree. the saddle also comprising a rigging material attached to each respective side of the saddle tree spaced from said centerline, each rigging material having a slot in the rigging material, each slot in the rigging material being large enough for at least a part of the stirrup leather or stirrup strap loop passing through the slot in the rigging material, each of these slots in the rigging material having a width for limiting the movement forward and/or rearward of a stirrup that is supported by each of the stirrup strap loops or stirrup leathers as each stirrup strap loop or stirrup leather moves parallel to the side of the equine bearing the saddle, each of the slots located in the rigging material on the saddle and offset from the slot in the respective side of the saddle tree of the saddle that supports the stirrup leather or stirrup strap loop.

2. The saddle of claim 1 wherein the rigging material is spaced from the centerline on each side of the saddle and fastened to the saddle tree below the slot in the saddle tree, the slot in each rigging material being for at least one part of the stirrup leather or stirrup strap loop to pass through the slot in the rigging material.

3. The saddle of claim 2 wherein the slot in the rigging material is about three to about six inches in length.

4. The saddle of claim 2 wherein the slot in the rigging material is about three to about four inches in length.

5. The saddle of claim 2 wherein the slot in the rigging material is so located such that when the rigging material is attached to the saddle tree a front of the slot in the rigging material is spaced downward about 5 to about 8 inches from a front of the saddle tree slot and a back of the slot in the rigging material is spaced downward about 4 to about 6 inches from a back of the saddle tree slot.

6. The saddle of claim 1 wherein the slot in the rigging material is about three to about six inches in length.

7. The saddle of claim 6 wherein the slot in the rigging material is so located such that when the rigging material is attached to the saddle tree a front of the slot in the rigging material is spaced downward about 5 to about 8 inches from a front of the saddle tree slot and a back of the slot in the rigging material is spaced downward about 4 to about 6 inches from a back of the saddle tree slot.

8. The saddle of claim 1 wherein the slot in the rigging material is about three to about four inches in length.

9. The saddle of claim 1 wherein the slot in the rigging material is so located such that when the rigging material is attached to the saddle tree a front of the slot in the rigging material is spaced downward about 5 to about 8 inches from a front of the saddle tree slot and a back of the slot in the rigging material is spaced downward about 4 to about 6 inches from a back of the saddle tree slot.

10. A saddle having at least one rigging, the rigging comprising a slot in a rigging material, at least one stirrup leather or stirrup strap loop, the slot in the rigging material being large enough for at least a part of the stirrup leather or stirrup strap loop passing through the slot in the rigging material and having a width for limiting movement forward and/or rearward of a stirrup that is supported by the stirrup leather or stirrup strap loop, the slot located in the rigging material spaced downward on the saddle and offset from a saddle tree slot in a saddle tree on a same side of the saddle tree as the rigging material.

11. The saddle of claim 10 wherein the rigging material extends on each side of the saddle from front of the saddle to beyond slot in the saddle tree, the slot in the rigging material allowing at least one part of the stirrup leather or stirrup strap loop to pass through, the rigging material slot being spaced downward from the slot in the saddle tree, the saddle tree supporting the stirrup leather or stirrup strap loop, the slot in the rigging material limiting the rearward and/or forward movement of the stirrup leather or stirrup strap loop parallel to the side of a horse bearing the saddle.

12. The saddle of claim 11 wherein the slot in the rigging material is about three to about six inches in length.

13. The saddle of claim 12 wherein the slot in the rigging material is so located such that when the rigging material is attached to the saddle tree a front of the slot in the rigging material is spaced downward about 5 to about 8 inches from a front of the saddle tree slot and a back of the slot in the rigging material is spaced downward about 4 to about 6 inches from a back of the saddle tree slot.

14. The saddle of claim 11 wherein the slot in the rigging material is about three to about four inches in length.

15. The saddle of claim 10 wherein the slot in the rigging material is about three to about six inches in length.

16. The saddle of claim 15 wherein the slot in the rigging material is so located such that when the rigging material is attached to the saddle tree a front of the slot in the rigging material is spaced downward about 5 to about 8 inches from a front of the saddle tree slot and a back of the slot in the rigging material is spaced downward about 4 to about 6 inches from a back of the saddle tree slot.

17. The saddle of claim 10 wherein the slot in the rigging material is about three to about four inches in length.

18. The saddle of claim 17 wherein the slot in the rigging material is so located such that when the rigging material is attached to the saddle tree a front of the slot in the rigging material is spaced downward about 5 to about 8 inches from a front of the saddle tree slot and a back of the slot in the rigging material is spaced downward about 4 to about 6 inches from a back of the saddle tree slot.

19. The saddle of claim 10 wherein the slot in the rigging material is so located such that when the rigging material is attached to the saddle tree a front of the slot in the rigging material is spaced downward about 5 to about 8 inches from a front of the saddle tree slot and a back of the slot in the rigging material is spaced downward about 4 to about 6 inches from a back of the saddle tree slot.

20. A method of making a saddle that includes a saddle tree, at least one stirrup leather or stirrup strap loop, and a rigging material comprising identifying a location for placement of a slot in the rigging material;

sizing the slot in the rigging material large enough to allow at least a part of the stirrup leather or stirrup strap loop to pass through this slot; and placing the slot in the rigging material and spacing the slot in the rigging material downward a distance and offset from a slot in the saddle tree of the saddle on the same side of the saddle tree as the rigging material for supporting the stirrup leather or stirrup strap loop in a way that controls forward and rearward movement of a stirrup supported by the stirrup leather or stirrup strap loop parallel to a side of an equine that will bear the saddle.

* * * * *